United States Patent [19]

Ebsen

[11] 4,155,667

[45] May 22, 1979

[54] SHORING DEVICE FOR SMALL CRAFTS

[76] Inventor: Ernst Ebsen, Ewaldsvej 9 A, Helsingør, Denmark, 3000

[21] Appl. No.: 861,438

[22] Filed: Dec. 16, 1977

[30] Foreign Application Priority Data

Dec. 29, 1976 [DK] Denmark ..... 5859/76

[51] Int. Cl.[2] ..... B63C 1/00

[52] U.S. Cl. ..... 405/7; 248/354 S

[58] Field of Search ..... 61/66, 67, 64; 248/354 S, 354; 269/296; 405/1, 7

[56] References Cited

U.S. PATENT DOCUMENTS

| | | | |
|---|---|---|---|
| 3,139,277 | 6/1964 | Mears | 61/66 X |
| 3,579,996 | 5/1971 | Edson | 61/66 |
| 3,586,285 | 6/1971 | Modzelewski | 61/66 X |

*Primary Examiner*—Jacob Shapiro

[57] ABSTRACT

The invention contemplates shoring structure for winter or other land-based storage of small boats, such as keeled sailboat hulls, wherein the basic structure is adaptable to the inherently stable and locked retention of each of a relatively wide variety of different hull shapes, and wherein such structure may be collapsed and stored within relatively compact volumetric confines.

1 Claim, 7 Drawing Figures

SHORING DEVICE FOR SMALL CRAFTS

Figure 1:
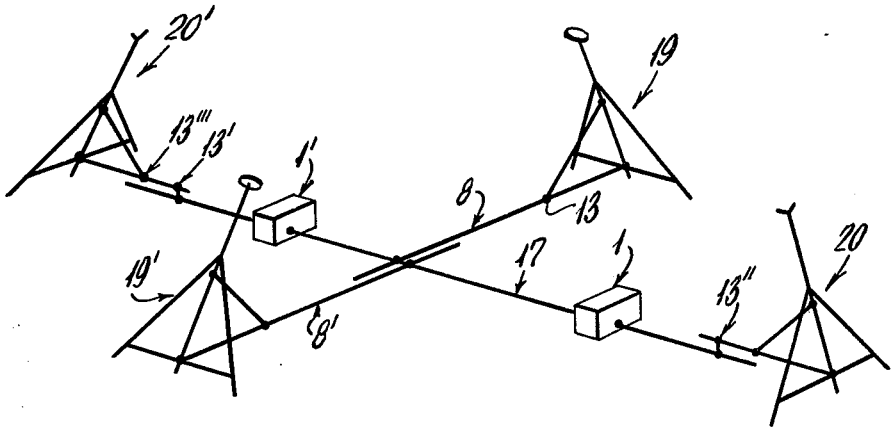

The present invention concerns an adjustable device for small ships and pleasure crafts placed on land for repair purposes or for storage during the winter.

When smaller crafts are to be placed on land they are most often placed with the keel on wooden blocks or on planks and the supporting itself is done by means of movable racks made of wood or steel.

When using the above mentioned shoring devices there is no guanantee that the devices are locked to the craft, and when vibrations are generated in the craft there is a danger of slipping so that the craft overturns. Besides, this kind of supporting system is poor when the keel is short and it therefore becomes necessary to support the stem and stern.

However, especially constructed supports are known. For instance a steel rack which has a rectangular bottom frame. In each corner a rather long supporting member is fastened and projects up and supports the craft. The four supporting members are connected to each other by means of a girder structure and are adapted so that they support the craft two by two in two point on each of the sides of the craft, the total number of supporting points being four. But this kind of supporting arrangement has several disadvantages as for instance occupying too much space and it cannot be disassembled. This kind of support is only handy in sizes intended for small crafts and it can only be used for the craft for which it was built.

However, more developed supports are known as shown in the Swedish patent specification No. 7108270-5 which shows an adjustable supporting mechanism by means of which a craft on land can be supported sideways, the two side supports being attached to each other by means of a connecting bar. Said design, however, only renders an apparent safety against overturning, which would happen if said connecting member slips under the craft or if the keel slips sideways on the connecting member. Furthermore, this design does not support the stem and stern.

The object of the present invention is to provide a shoring device of the type mentioned in the introduction, the new support being designed without having the above mentioned disadvantages. This advantage is obtained according to the invention by designing a device of the type described in the introduction of claim 1 as described in the characterizing part of said claim.

When designed in this way the result is a supporting arrangement where the craft is supported sideways and under the keel, and at the same time the keel prevents the supporting system from slipping because the keel rests on the underlying blocks. The four adjustable supports remain in their adjusted position. This kind of supporting arrangement prevents the keel from slipping sideways not only because the keel rests on the blocks but also because the blocks are a part of the system and are attached to the four supporting elements. A further advantage is that the supporting arrangement can be used for crafts of different sizes. A further advantage is that the supporting arrangement is easy to handle and, furthermore, can be disassembled and easily stored when not being used.

Designing the subject matter of the invention as described result in that the four supporting elements easily can be adjusted to the desired inclination, and that the supporting member itself can be pressed towards the side of the craft or its stem and stern so that the support becomes stable and secure.

Designing the side supports as described result is an especially stable support of the craft sideways.

Figure 2:
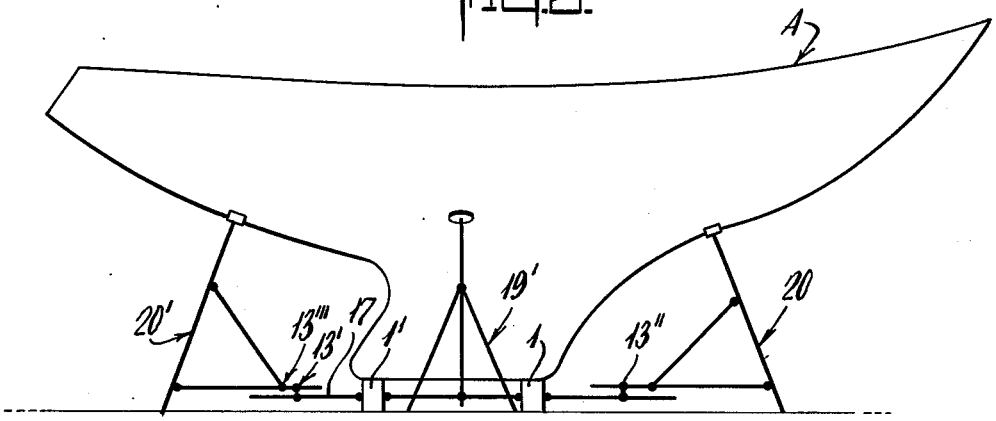
Figure 3:
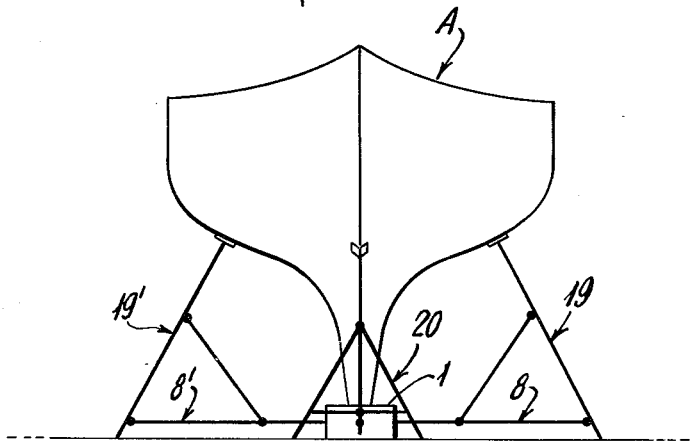
Figures 4, 5A, 5B:
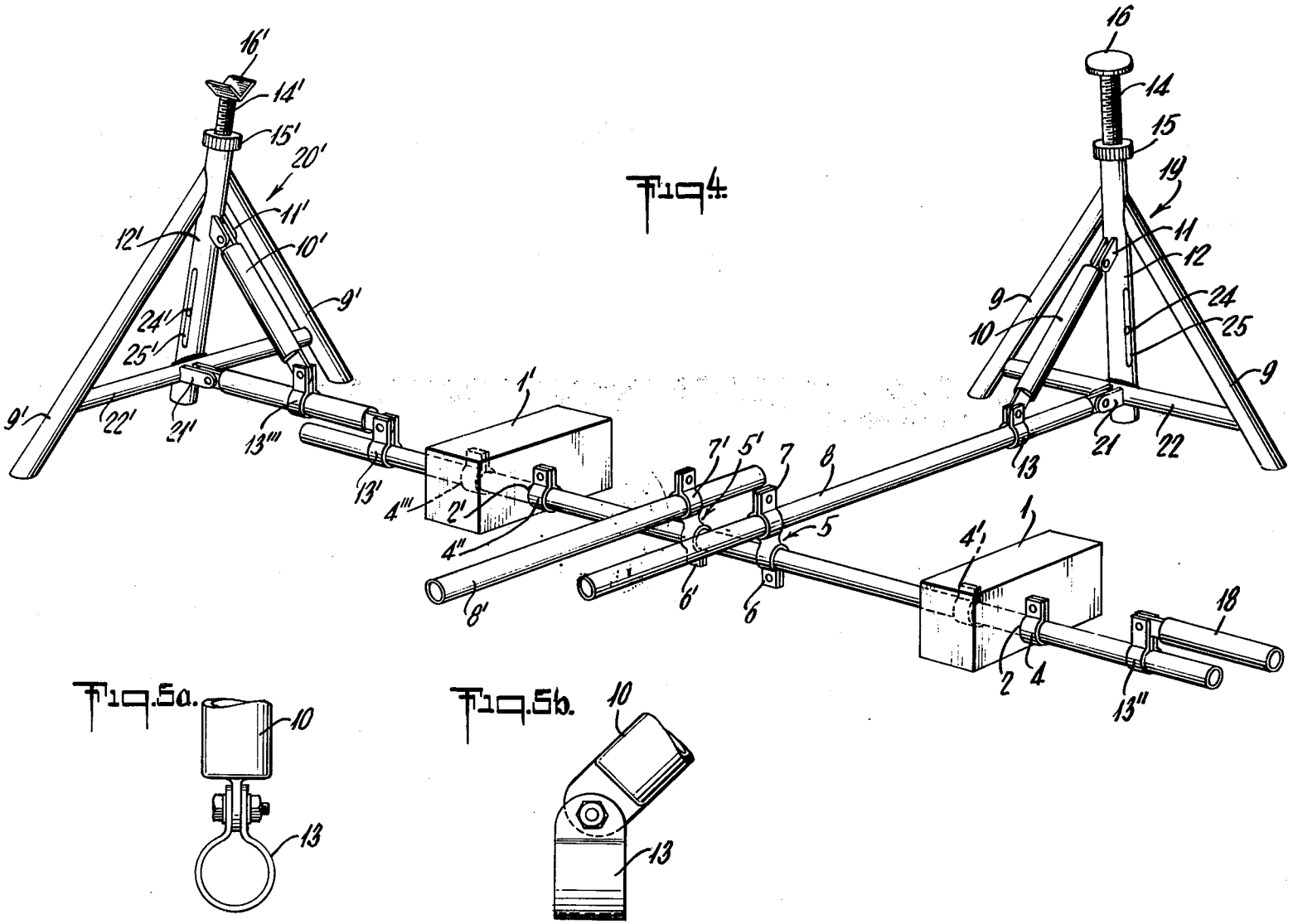
Figure 6:
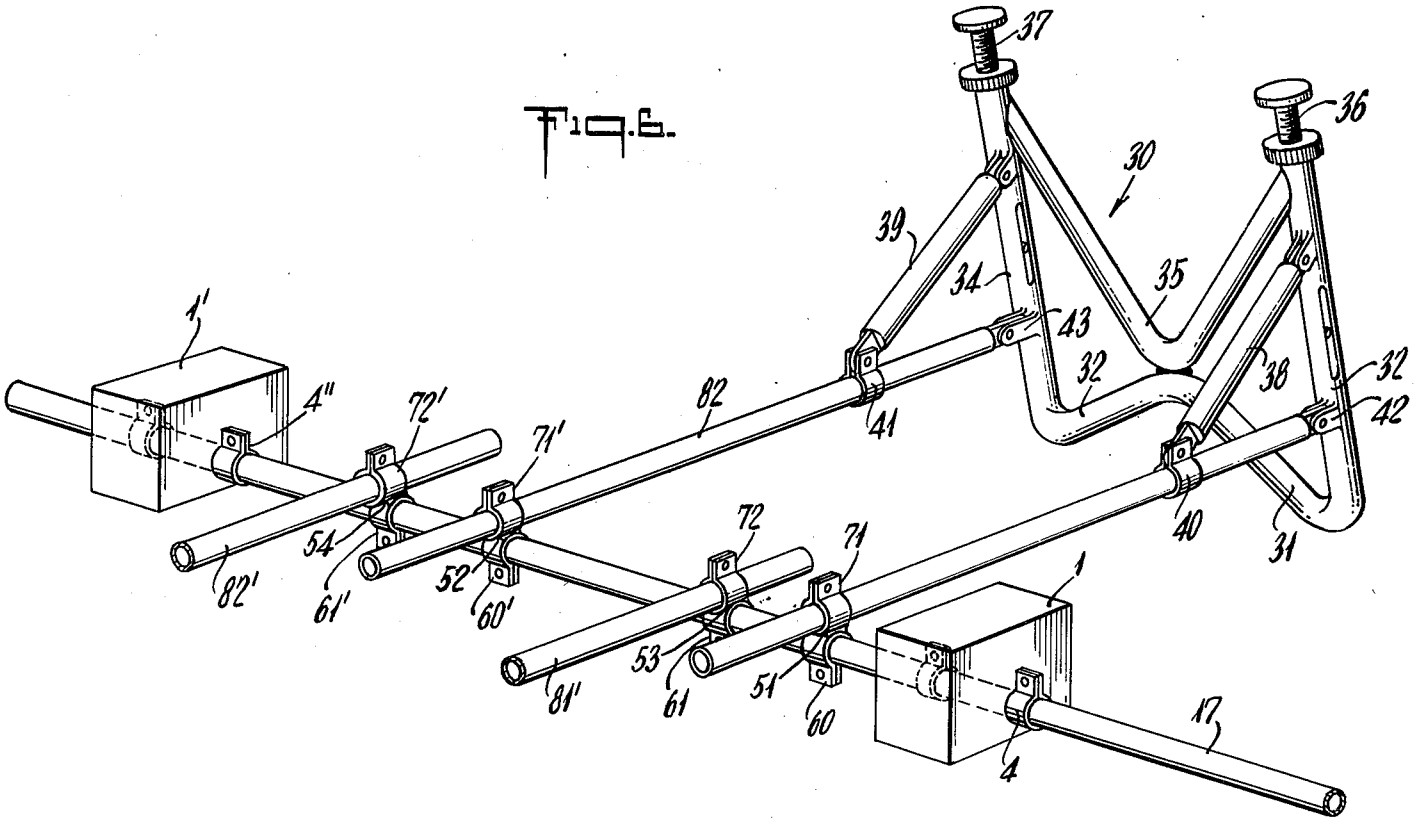

The invention is described in further detail in connection with the drawing, where FIG. 1 is a sketch of the design according to the invention and seen in perspective, FIG. 2 shows the subjects matter of the invention when in use. The supported craft is shown in side view, FIG. 3 is a front view of the invention, FIG. 4 is a perspective drawing of the subject matter of the invention but in more detail. In order to make the drawing better understandable only one of two identical mechanisms is shown acting as stem support, and similarly only one of two identical mechanisms is shown acting as side support for the craft, FIGS. 5*a* and 5*b* are fragmentary, being respectively end and side views of stay-connection elements forming part of the structure of FIG. 4, and FIG. 6 is a perspective drawing of one embodiment the side supports of which are designed as double supports but only one side support is shown.

Two rather long blocks with rectangular crossectional area are designated 1 and 1', respectively, FIG. 4. They are preferably made of wood and are placed on the ground so that their axis in the lengthwise direction are parallel and have tranverse, circular holes which are designated 2 and 2', respectively, and that the longitudinal axis of said holes are parallel with the side surface which constitutes the bottom surface of the blocks. A rather long steel tube 17 is put through the holes of the two blocks and said tube 17 is so long that both ends protrude from the blocks, when said blocks are placed with the desired distance between them. The distance between the blocks 1 and 1', which serve as support for the keel, is dependent on the length of the keel. Tube 17 is kept in place relative to the blocks by means of four stop elements 4, 4', 4'', and 4''', which are clamped two by two around tube 17 close to the respective side surfaces of the blocks. Two adjustable clamps 5 and 5'are clamped around tube 17 between the blocks 1 and 1'. Said clamps 5 and 5'are each made of two shackles 6,7 and 6', 7', welded together. The welding is made so that the identical clamps 5 and 5' each can be clamped around and hold two pieces of tube the axis of which are perpendicular to each other. The tubular clamps 6 and 6' are both clamped on tube 17, and clamp 7 is clamped around the one end of a rather long tube 8, whereas clamp 7' is clamped around one end of a rather long tube 8'. Tubes 8 and 8' are placed so that their axis are parallel with the bottom surface, their axis being approximately parallel to each other and tubes 8 and 8' are essentially placed on each side of and perpendicular to tube 17. Tubes 8 and 8' are flattened in the opposite end and a hole is drilled through the flat part so that each of them may be rotary supported on the plane support structures 19 and 19', respectively (FIG. 1). Because structures 19 and 19' are identical but in a mirrored position relative to each other it suffices to describe structure 19 in further detail, said structure being rotary supported on the flat end of tube 8.

The side-supporting structure can be made as a single-point support supporting the side of the craft at only one point, or as a double-point support that supports the side of the craft at two points.

Side support 19 shown in FIGS. 1 and 4 is a single-point support which is in the form of a mainly plane isosceles triangle structure where the legs 9 rest on the ground. Said legs protrude a little outside a horizontal bar 22, which make up the base line of the triangle structure. At the middle of bar 22 a fork-shaped element 21 with a hole is fastened. The fork-shaped part of said element 21 is fitted around the flat end of tube 8. Element 21 is fastened to structure 19 so that the inner surfaces of fork 21 are vertical when 19 rests on the legs 9. Because the triangle structure 19 is rotary supported on tube 8 structure 19 can rotate around the horizontal axis passing through the point of support so that it rotates in a vertical plane passing through the center line of tube 8, i.e. so that the rotation takes place in a vertical plane which is in a transverse direction to the craft. Structure 19 comprises also a tube 12 which is welded to the middle of link 22 so that said tube 12 forms the height on link 22 in the triangle structure. In tube 12 a suitably dimensioned bar 14 of steel is placed. Bar 14 is provided with a short tap 24 at the bottom, and said tap protrudes in radial direction a little outside the surface of the bar. Tube 12 has in the longitudinal direction a corresponding slot 25 slong the tube. Tap 24, therefore, can be moved in a longitudinal direction to the bar along slot 25; the result is that bar 14 can be moved but cannot rotate in tube 12. Bar 14 is made with a thread almost along its entire length and a nut 15, which is screwed on bar 14 and rests on the upper edge of tube 12, can therefore be used to clamp bar 14 against the side of the craft. Bar 14 is on its top provided with a supporting plate 16. In order that structure 19 can be clamped with the correct inclination relative to the craft a fork-shaped part 11 is welded to the top of the triangle structure 19 on the side towards the craft. Part 11 is provided with a hole through the two flat parts of the fork and part 11 is welded to 19 so that the parallel surfaces of said flat parts are vertical. A bar 10 preferably made of steel tubing with flat ends provided with a hole fits with its one flat end in fork 11 and is thus rotary supported on fork 11. The other end of bar 10 is rotary supported between the flat parts of a strong tubular clamp 13 which can be clamped around tube 8 in any desired position. By means of the rotating and, therefore, adjustable bar 10 and the tubular clamp 13 structure 19 may be clamped in a suitable inclination relative to the craft. One embodiment of the tubular clamp 13 is shown in more detail in FIG. 5.

By means of the tubular clamp 7 tube 8 and structure 19 may be moved in the side direction of the craft and may be clamped in the position which corresponds to the width of the craft in question. By means of the tubular clamp 6 tube 8 and structure 19 may be moved in the longitudinal direction of the craft and may be placed and clamped at the middle of the craft.

At each end of tube 17 a tubular clamp 13' and 13'', respectively, are mounted. Said clamps are identical and may be clamped around tube 17 and at the same time they are rotary supported on one end of tubes 18' and 18, respectively. On the other end of tubes 18' and 18 support structures 20' and 20, respectively, are attached (FIGS. 1 and 2). Because structures 20' and 20 are identical but placed in a mirrored position relative to each other, only structure 20' will be explained here in further detail. Structure 20' is almost identical to structure 19 already described, and structure 20' is fastened to tube 18' exactly the same way as 19 is fastened to 8. The supporting plate on top of the threaded bar 14' is designated 16' and is bent in an angle so that a non-slipping support of stem and stern of the craft is obtained, because structure 20' — like structure 20 — acts as support for the stem or stern. Structure 20' and 20, which make up the support of the stem and stern, can be adjusted in the longitudinal direction of the craft by means of the tubular clamps 13' and 13'', respectively. By means of the movable tubular clamp 13''' which can be clamped around tube 18', structure 20' may be clamped with a suitable inclination relative to the craft and the same holds for structure 20.

The adjustable side supports may each be designed as two-point supports which support each side of the craft at two points. FIG. 6 shows the design of a two-point support. Tube 17 carries four tubular clamps two of which are shown in FIG. 6. Said clamps are designated 51 and 52, respectively, and hold two rather long tubes designated 81 and 82, respectively. The supporting structure itself, which is designated 30, is designed as a plane tube structure where the lowest corners 31 and 32 rest against the ground and the two tube ends 33 and 34 are parallel and fitted with a support 35 which is bent in an angle.

The adjustable threaded members 36 and 37 are mounted on tubes 33 and 34. Members 38 and 39 are rotary supported at the top of tubes 33 and 34. Said members 38 and 39 are rotary supported on tubular clamps 40 and 41, respectively. Said clamps are movable on, and may be clamped to, tubes 81 and 82, respectively. Structure 30 is at its bottom in each side rotary supported on the flat ends of tubes 81 and 82. Fork-shaped parts 42 and 43, respectively, are welded on tubes 33 and 34, respectively. Said fork-shaped parts are provided with a hole and fit around the flat ends of tubes 81 and 82 which, too, are provided with a corresponding hole so that the structure 30 is supported on tubes 81 and 82 so that said structure can be rotated in a vertical plane around a mainly horizontal axis through the holes of parts 42 and 43. Thus the structure 30 may be adjusted in a suitable inclined position relative to the side of the craft and that said structure — similarly to structure 19 already described — may be adjusted to crafts of different widths and also be adjusted in the lengthwise direction of the craft.

When a craft is to be placed on the support according to the invention the craft is lowered on to the carrying blocks and then the structures to the side supports and supports of stem and stern are adjusted and clamped at a suitable distance from the sides of the craft and from the stem and stern, and then the supporting structures are adjusted with the correct inclination and clamped in position, and finally the four spindles are rotated so that the corresponding supporting plates are pressed against the craft.

I claim:

1. An adjustable shoring device for stabilized support of a keeled hull, said device comprising an elongate longitudinal frame member, two keel-supporting blocks and means for adjustably clamping said blocks to said frame member at longitudinally spaced locations along said frame member, elongate transverse frame-member means and means for clamping the same to said longitudinal member with a first frame-member portion projecting to one transverse side of said longitudinal frame member and with a second frame-member portion projecting to the other transverse side of said longitudinal frame member, first and second upstanding side-stabilizing structures connected to the respective projecting ends of said first and second frame-member portions, third and fourth upstanding bow and stern stabilizing structures connected to the respective longitudinal ends of said longitudinal frame member, hull-engaging means adjustably carried by upper ends of said stabilizing structures, and means for releasably clamping said hull-engaging means in adjusted position of hull-engagement when the keel of a particular hull is fore-aft supported upon said blocks.

* * * * *